US006742323B2

(12) United States Patent
Apel et al.

(10) Patent No.: US 6,742,323 B2
(45) Date of Patent: Jun. 1, 2004

(54) PACKAGE-STRAPPING APPARATUS

(75) Inventors: Stefan Apel, Menden (DE); Reinhard Naydowski, Ennepetal (DE); Thomas Schäfer, Ludenscheid (DE)

(73) Assignee: Titan Umreifungstechnik GmbH & Co. KG, Schwelm (DE)

( * ) Notice: Subject to any disclaimer, the term of this patent is extended or adjusted under 35 U.S.C. 154(b) by 0 days.

(21) Appl. No.: 10/420,958

(22) Filed: Apr. 22, 2003

(65) Prior Publication Data

US 2003/0221566 A1 Dec. 4, 2003

(30) Foreign Application Priority Data

Apr. 23, 2002 (DE) ..... 102 18 135

(51) Int. Cl.[7] ..... B65B 13/22

(52) U.S. Cl. ..... 53/589; 53/592; 100/29; 100/32

(58) Field of Search ..... 53/589, 592; 100/25, 100/26, 29, 32

(56) References Cited

U.S. PATENT DOCUMENTS 4,516,488 A * 5/1985 Bartzick et al. ..... 100/32
4,995,776 A * 2/1991 Kato ..... 100/32
5,379,576 A * 1/1995 Koyama ..... 100/32
5,651,306 A * 7/1997 Hoshino ..... 100/32
6,041,581 A * 3/2000 Huber ..... 100/32
6,155,032 A * 12/2000 Lai ..... 100/32
6,517,652 B1 * 2/2003 Gratz ..... 156/73.5
6,655,117 B2 * 12/2003 Hoshino ..... 53/589

FOREIGN PATENT DOCUMENTS

DE 3249559 * 8/1985 ..... B65B/13/22
DE 100 26 200 11/2001
FR 2310265 * 12/1976 ..... B65B/13/22

* cited by examiner

*Primary Examiner*—Stephen F. Gerrity
(74) *Attorney, Agent, or Firm*—Herbert Dubno; Andrew Wilford

(57) ABSTRACT

A strapping apparatus for securing a tape around a package has a housing, a support roll rotatable on the housing, a tube shaft pivotal on the housing adjacent the support roll about a tube-shaft axis, and a drive shaft rotatable in the tube shaft about a drive-shaft axis parallel to and offset from the tube-shaft axis. A first drive roll on the drive shaft carries a friction layer bearing axially offset from the drive-shaft axis on the housing. A first drive connected to the drive shaft rotates same and the first drive roll in a clamping direction and thereby oppositely rotates the tube shaft about the tube-shaft axis into an end position and also can rotate the drive shaft and the first drive roll in an opposite freeing direction to thereby oppositely rotate the tube shaft about the tube-shaft axis into another end position.

20 Claims, 4 Drawing Sheets

PACKAGE-STRAPPING APPARATUS

FIELD OF THE INVENTION

The present invention relates to an apparatus for wrapping a band or strip about an object. More particularly this invention concerns an apparatus for securing plastic strapping around a package to be shipped or mailed.

BACKGROUND OF THE INVENTION

As described in German patent document 100 26 200 of Detleff Scholl et al, a package-strapping apparatus has a housing with a tightening wheel that can be urged against a pair of superposed plastic tapes. A complex system of an overload-cutoff motor, a friction brake, and several one-way clutches cooperate with an eccentric mechanism to allow the wheel to be moved into and out of pinching engagement with the two tapes, and to rotate it in a forward direction that draws them tightly about a package they are looped around, and oppositely to feed in new tape.

This arrangement is quite complex with numerous parts, like the one-way clutches and friction brake, that change operational characteristics with wear so that the device needs frequent attention and adjustment. Furthermore the structure is quite bulky, and in general this strapping apparatus is fairly expensive.

OBJECTS OF THE INVENTION

It is therefore an object of the present invention to provide an improved strapping apparatus.

Another object is the provision of such an improved strapping apparatus which overcomes the above-given disadvantages, that is which is of simple, reliable, compact, and inexpensive construction.

SUMMARY OF THE INVENTION

A strapping apparatus for securing a tape around a package has according to the invention a housing, a support roll rotatable on the housing, a first clamp on the housing for clamping a free end of the tape to the housing, a second clamp on the housing for clamping the tape offset from its free end to the housing, a cutter on the housing for cutting the tape upstream of the second clamp, and a joiner for securing the tape to itself upstream of the second clamp. A tube shaft is pivotal on the housing adjacent the support roll about a tube-shaft axis, and a drive shaft is rotatable in the tube shaft about a drive-shaft axis parallel to and offset from the tube-shaft axis. A first drive roll on the drive shaft carries a friction layer bearing axially offset from the drive-shaft axis on the housing. Abutments carried by the housing and the tube shaft limit angular movement of the tube shaft about the tube-shaft axis between one end position in which the first drive roll is spaced from the support roll and an opposite end position in which the first drive roll bears via the tape on the support roll. A first drive connected to the drive shaft rotates same and the first drive roll in a clamping direction and thereby oppositely rotates the tube shaft about the tube-shaft axis into the opposite end position and also can rotate the drive shaft and the first drive roll in an opposite freeing direction to thereby oppositely rotate the tube shaft about the tube-shaft axis into the one end position. A controller connected to the first and second clamp, joiner, and first drive synchronizes operation of same.

This structure is extremely compact and simple. The friction layer on the drive roll replaces a complex mechanism employed in the prior art to shift this drive roll into and out of engagement with the support roll. This much simpler mechanism is extremely reliable and has a long service life.

In use the tape passes from a standard supply spool through the strapping apparatus, being spanned over the support roll. A length of the tape at the free end is looped around a package and then inserted into the first clamp by an operator of the machine. The first clamp according to the invention includes a switch connected to the controller and operable by insertion of the free tape end into the first clamp. This switch initially operates the first clamp to lock the free end in place. The controller connected to this switch then operates the drive to rotate the drive shaft in the clamping direction after the switch is operated. Thus poking the free tape end into the first clamp initiates the strapping cycle.

The tube shaft according to the invention carries a tape guide engaging and guiding the tape in the one end position and out of engagement with the tape in the opposite end position. Furthermore, a second drive is provided including a second drive roll engageable with the tape on the support roll and connected to the controller for advancing the tape out of and drawing the tape back into the apparatus. The function of this second drive is to extend enough tape to wrap around the package, and then loosely snug it around the package.

The second drive includes a rocker carrying the second drive roll and pivotal on the housing into and out of a pinching position with the second drive roll pressing the tape against the support roll, and spring biasing mens connected between the rocker and the housing for urging the rocker into the pinching position. Thus this second drive roll constantly presses the tape against the support roll with a generally constant force.

The controller according to the invention includes a start switch operable for initiating rotation of the second drive roll in a direction advancing the tape out of the apparatus. The controller can then automatically stop the second drive roll a predetermined time after operation of the switch so as to extend a predetermined length of the tape.

The second drive includes a reversible electric motor connected to the second drive roll. The switch of the first clamp is connected to the controller so that it can operate the second drive to draw the tape back into the apparatus after the switch is operated. In addition, the controller operates the second drive to draw the tape back into the apparatus a predetermined time after the switch is operated. The switch is a time-delay switch. More particularly the second drive includes a second motor and the controller monitors loading of the second motor and starts the first drive when loading of the second drive motor exceeds a predetermined limit. Thus the first drive, which is the one used to pull the tape very tight around the package, only steps into action when the tape has been snugged loosely around the package by the second drive. In fact the first drive roll does not even engage the tape until the second drive has payed it out and wound it back in.

To achieve this effect the first drive includes a first motor and the controller monitors loading of the first motor and operates the second clamp to clamp the tape when loading of the first drive motor exceeds a predetermined limit. After operating the second clamp to clamp the tape the controller operates the cutter to sever the tape upstream of the second clamp. Similarly, after operating the second clamp means to clamp the tape the controller operates the joiner to secure the tape to itself upstream of the second clamp and downstream of the cutter.

The second drive roll is provided with externally operable hand formations for manual rotation of the second drive roll. Furthermore the first drive includes a motor and a worm-gear transmission connected between the motor and the drive shaft and constructed to be self-blocking. Thus if the first drive stops, the tape will not slide back out and loosen; instead it will be solidly blocked until the first drive is actually reversed to back off the first drive roll.

A spring is braced according to the invention between the friction layer and the first drive roll for pressing the friction layer against the housing. This spring is a stack of Belleville washers.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
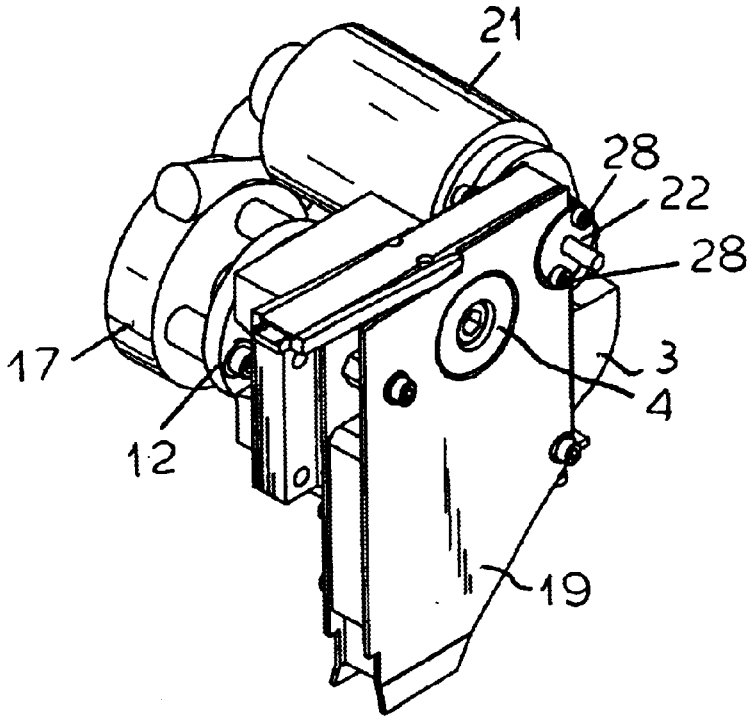
FIG. 1 is a perspective view of the tape-handling subassembly of the apparatus according to the invention.

As seen in the drawings, the instant invention is an apparatus for wrapping a package 1 or the like with plastic tape or strapping 2. The apparatus basically comprises a housing 3 that is stationary, to which the tape 2 is fed from below, and on which the package 1 is set. A main rubber-coated idling support roll 4 is rotatable on the housing 3 and a drive roll 5 can pinch the tape 2 against this support roll 4. The apparatus further has a conventional clamp 6 for the free end of the tape 2 looped around the package 1 and another clamp 7 engageable further along the tape 2, so that a loop of the tape 2 can be held around the package between the clamps 6 and 7. A cutter 8 and welder 9 of standard construction can cut the loop of tape 2 free from the incoming tape 2 and can weld the ends of the loop around the package 2 together once they have been tensioned as described below.

Figure 6:
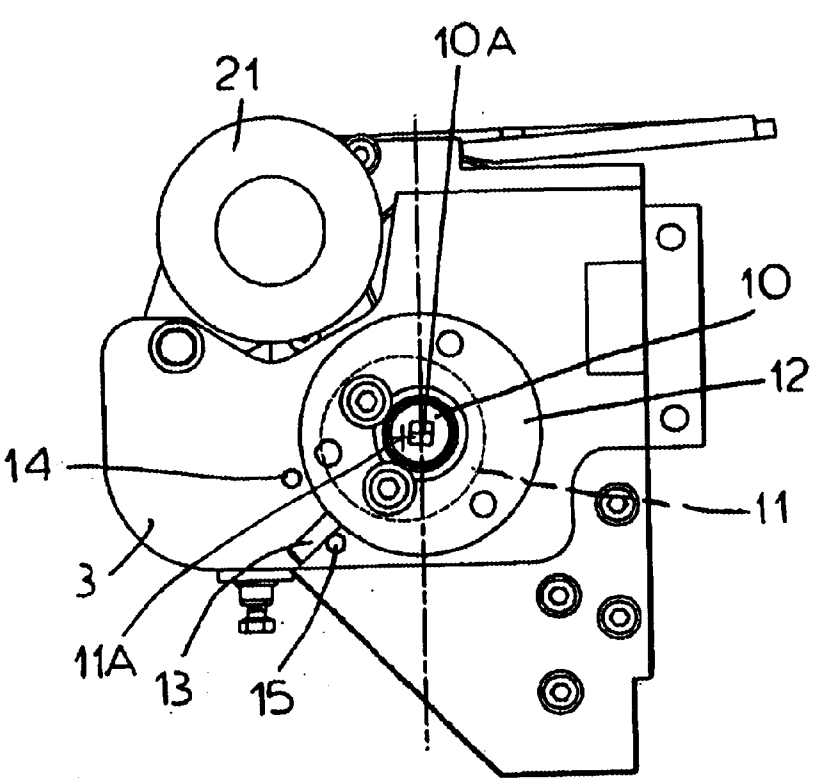
FIG. 6 is a rear view of the strapping apparatus in the direction of arrow VI of FIG. 5.
Figure 5:
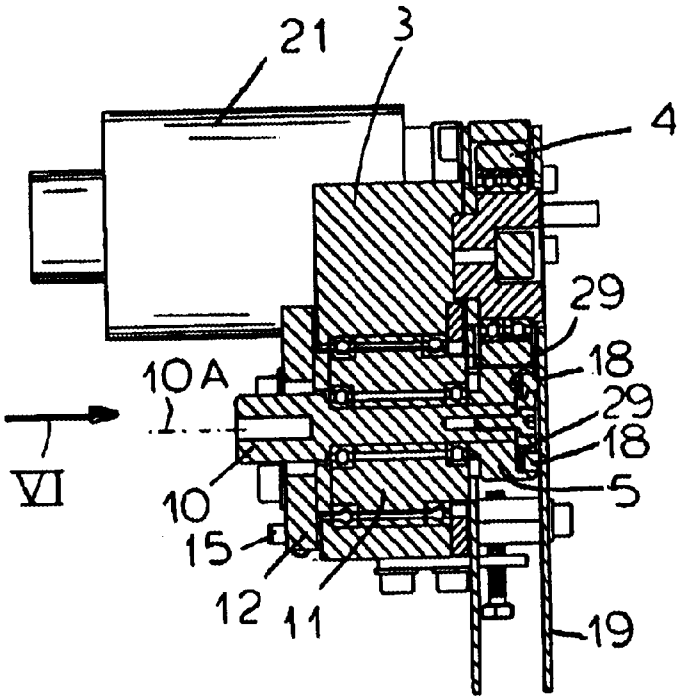
FIG. 5 is a section through the apparatus taken along line V—V of FIG. 3.
Figure 8:
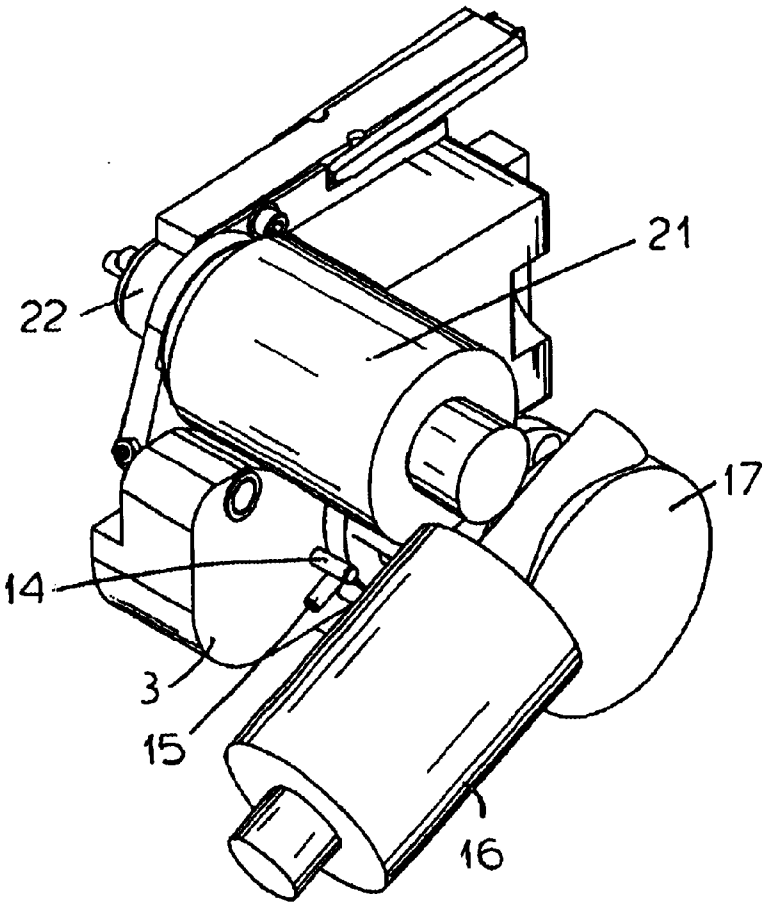
FIG. 8 is a perspective view from above and behind of the apparatus.
Figure 7:
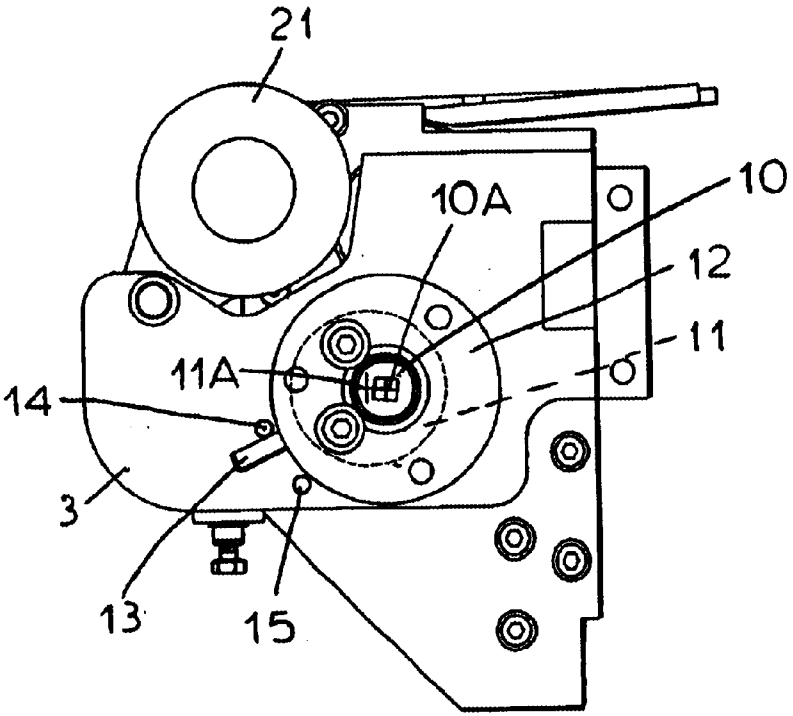
FIG. 7 is a view like FIG. 6 but in the clamping position.

The roll 5 is carried on a shaft 10 journaled at an axis 10A eccentrically in a tube shaft 11 itself journaled in the housing 3 at an axis 11A offset from the axis 10A. A disk 12 fixed to a rear end of the shaft 11 has a radially projecting formation or pin 13 movable between two angularly spaced abutments 14 and 15 fixed on the housing 3 as shown in FIGS. 6 and 7. Thus this limited angular movement of the tube shaft 11 about its axis 11A radially displaces the roll 5 into and out of engagement with the roll 4.

The plate 12 also carries a reversible drive motor 16 and a transmission 17 connected to the shaft 10. The motor's unillustrated output shaft extends secantally of the axis 10A and carries an unillustrated worm meshing with an unillustrated large-diameter input gear itself centered on the axis 10A so that a large step-down is achieved and the drive is self-locking, that is it can transmit torque from the motor 16 to the shaft 10 but not in the opposite direction. As a result when the motor 16 is arrested, the shaft 10 and roll 5 are effectively locked against rotation.

Figure 3:
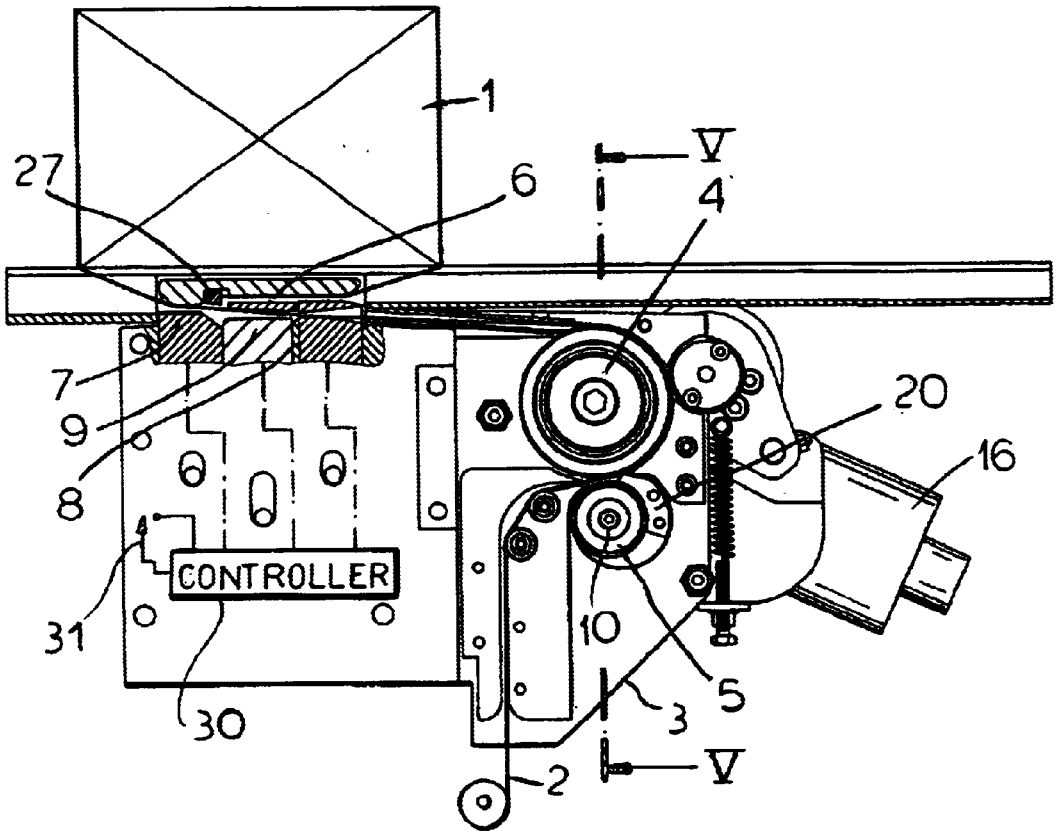
FIG. 3 is a partly sectional front view of the strapping apparatus in accordance with the invention in a starting position.
Figure 4:
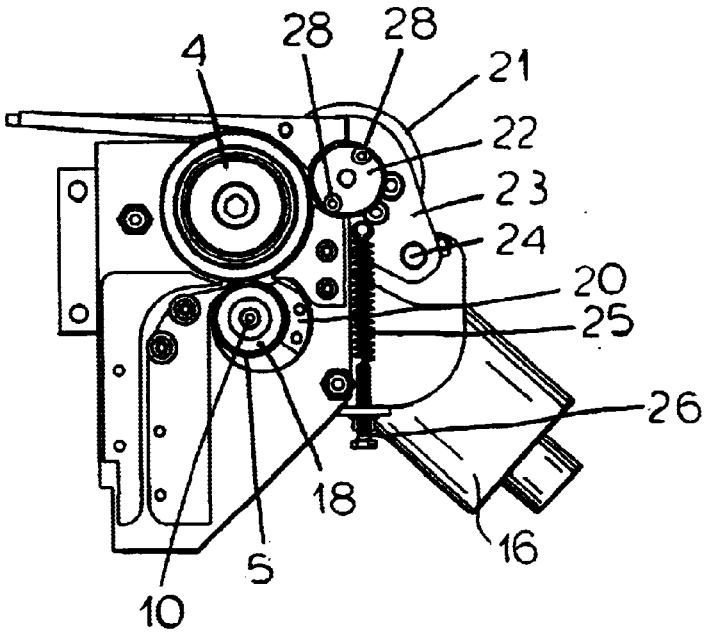
FIG. 4 is a view of a detail of FIG. 3 but in a clamping/tightening position.

An end face of the roll 5 bears with an elastomeric coating 18 on an abutment plate 19 fixed on the housing 3 so that when the drive 16 is started the disk 12 is moved with its formation 13 from the position of FIGS. 3 and 6 with the rolls 4 and 5 spaced into the position of FIGS. 4 and 7 with the roll 5 pressed against the roll 4 directly or via the tape 2. The coating 18 and plate 19 form a friction coupling that transmits torque to the shaft 11. Only when the disk 12 moves the formation 13 against the abutment 14 as shown in FIG. 7, is rotation of the disk 12 stopped while the roll 5 which is directly mounted on the shaft 10 continues to rotate. The amount of frictional engagement between the roll 5 and the housing 3 is determined by the spring force of a stack of Belleville washers 29 engaged between the friction layer 18 and the shaft 10.

Figure 2:
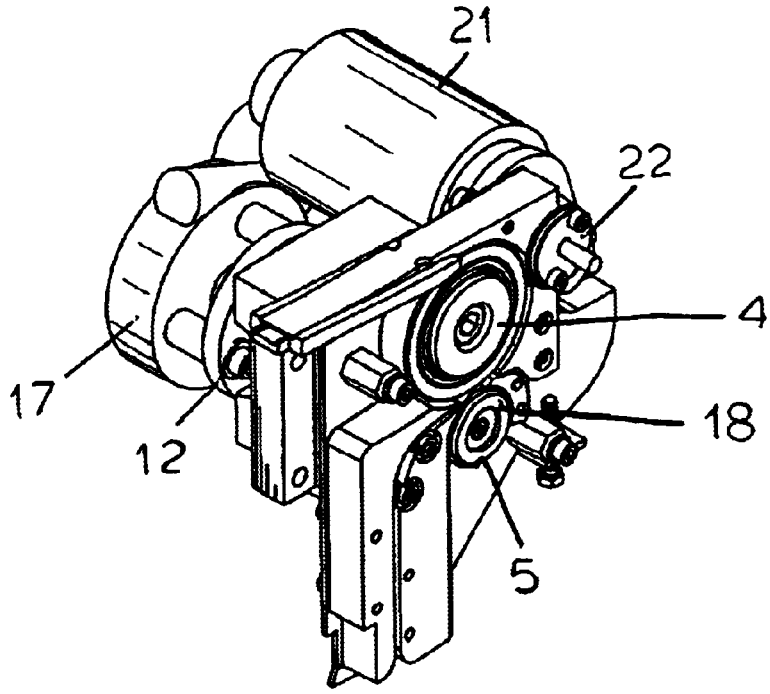
FIG. 2 is a view like FIG. 1 but with a cover plate removed.

Thus when as seen in FIGS. 2 and 3 the shaft 10 is rotated counterclockwise (clockwise as seen in FIGS. 6 and 7), the first thing that happens is that the frictional engagement of the layer 18 on the plate 19 rotates the tube shaft 11 from the position of FIG. 6 to that of FIG. 7 so as to pinch the tape 2 with the roll 5 against the roll 4. Once this end position is reached, the shaft 11 can no longer rotate in the housing 3 and continued rotation of the shaft 10 will simply drive the roll 5 in a direction to pull the tape 2 back in, the layer 18 slipping on the plate 19. From this clamping/tightening position of FIGS. 4 and 7, reverse rotation of the roll 5 by the drive formed by the motor 16 and transmission 17 will initially reverse rotate the shaft 11 (clockwise as shown in FIGS. 2 and 3, counterclockwise in FIGS. 6 and 6) so as to pull the roll 5 off the roll 4, and subsequent reverse rotation will be ineffective as the rolls 4 and 5 will not be pinching the tape 2.

The eccentric tube shaft 11 also carries a tape-guiding wedge 20 that moves angularly with this shaft 11. In the FIG. 3 open position of the rolls 4 and 5, this wedge 20 serves to guide the tape 2. When the rolls 4 and 5 are engaged together, the wedge 20 is moved out of engagement with the tape 2.

The apparatus also has a secondary tape drive with a motor 21 carried on a rocker 23 pivoted at 24 on the housing 3 and having an output shaft carrying a drive roll 22 that can be pressed radially against the roll 4 downstream from the roll 5. A tension spring 25 is hooked at one end on the rocker 23 and at its opposite end on an adjustment screw 26 on the housing 3 so that the pressure with which the roll 22 is urged against the roll 4 can be adjusted. Hand knobs 28 on the roll 22 allow it to be turned by hand to thread tape 2 through the apparatus on setup.

A controller 30 is connected to a switch 27 associated with the clamp 6, with the clamps 6 and 7, with the cutter 8, and with the welder 9. It is also connected to the two motors 16 and 21 which are both reversible. The controller 30 is programmed to operate the system in the following manner.

Presuming a package 1 is sitting on the apparatus, a start switch 31 is actuated and the motor 21 is started by the controller 30 so as to rotate the roll 22 clockwise as seen in FIGS. 3 and 4 and thereby feed a length of the tape 2 through the device to the back of the package 1. How long the roll 22 is rotated depends on how large the package 1 is, a parameter that can be programmed into the controller 30 or the start switch 31 can be set to release a predetermined amount of tape each time it is pressed, so long as the switch 27 is not actuated. The machine operator loops the tape 2 around the package and pokes its end into the clamp 6, thereby actuating the switch 27 which immediately closes the clamp 6 to grab the leading end of the tape 2.

Shortly after actuation of this switch 27 is detected, the controller 30 reverses rotation of the roll 22 to pull the loop of tape 2 snug around the package 1. Since the roll 22 can slip relatively easily on the tape 2 on the roll 4, the amount of tension it can impart to the tape 2 is modest. Thus even if the operator still has a hand or finger under the tape 2, no harm will be done and in fact the tape 2 can be adjusted during this initial tightening stage.

Once the controller 30 determines that the motor 21 is drawing an amount of current indicating that it is stalled or slipping, it energizes the motor 16 and, after a short delay, de-energizes the motor 21. The motor 16 is set to rotate the shaft counterclockwise as shown in FIGS. 2 and 3 and clockwise as shown in FIGS. 6 and 7. As described above the initial effect of this is to move in the roll 5 to solidly clamp the tape 2 between the rolls 5. Subsequent rotation draws the tape 2 back, rotating the roll 4 clockwise as shown in FIGS. 3 and 4. The roll 5 is capable of exerting substantial tension on the tape 2, getting it very tight around the package.

When the controller 30 determines that the motor 16 is drawing an amount of current indicating that it is stalled, it first operates the clamp 7 to arrest the tape 2 then reverses rotation of the motor 16 briefly. The cutter 8 and welder 9 are then operated to free the loop of tape 2 surrounding the package 1 and weld its ends together, whereupon the clamps 6 and 7 are released. The package 1 can be lifted off the apparatus or another strap can be applied around it.

Instead of electrical motors 16 and 21 it would be possible to use pneumatic or hydraulic motors. In this case the pressure of the fluid powering the motors would be monitored (instead of current drawn) to determine when they are stalled or slipping.

We claim:

1. A strapping apparatus for securing a tape around a package, the apparatus comprising:

a housing;

a support roll rotatable on the housing, the tape being spanned over the support roll;

first clamp means on the housing for clamping a free end of the tape to the housing;

second clamp means on the housing for clamping the tape offset from its free end to the housing;

cutting means on the housing for cutting the tape upstream of the second clamp means;

joining means for securing the tape to itself upstream of the second clamp means;

a tube shaft pivotal on the housing adjacent the support roll about a tube-shaft axis;

a drive shaft rotatable in the tube shaft about a drive-shaft axis parallel to and offset from the tube-shaft axis;

a first drive roll on the drive shaft;

a friction layer carried on the drive roll and bearing axially offset from the drive-shaft axis on the housing;

means including abutments carried by the housing and the tube shaft for limiting angular movement of the tube shaft about the tube-shaft axis between one end position in which the first drive roll is spaced from the support roll and an opposite end position in which the first drive roll bears via the tape on the support roll; and first drive means connected to the drive shaft for rotating same and the first drive roll in a clamping direction and for thereby oppositely rotating the tube shaft about the tube-shaft axis into the opposite end position and for rotating the drive shaft and the first drive roll in an opposite freeing direction and for thereby oppositely rotating the tube shaft about the tube-shaft axis into the one end position; and control means connected to the first and second clamp means, joining means, and first drive means for synchronizing operation of same.

2. The strapping apparatus defined in claim 1 wherein the first clamp means includes a switch connected to the control means and operable by insertion of the free tape end into the first clamp means.

3. The strapping apparatus defined in claim 2 wherein the control means operates the drive means to rotate the drive shaft in the clamping direction after the switch is operated.

4. The strapping apparatus defined in claim 1 wherein the tube shaft carries a tape guide engaging and guiding the tape in the one end position and out of engagement with the tape in the opposite end position.

5. The strapping apparatus defined in claim 1, further comprising second drive means including a second drive roll engageable with the tape on the support roll and connected to the control means for advancing the tape out of and drawing the tape back into the apparatus.

6. The strapping apparatus defined in claim 5 wherein the second drive means includes:

a rocker carrying the second drive roll and pivotal on the housing into and out of a pinching position with the second drive roll pressing the tape against the support roll; and biasing means connected between the rocker and the housing for urging the rocker into the pinching position.

7. The strapping apparatus defined in claim 6 wherein the control means includes a start switch operable for initiating rotation of the second drive roll in a direction advancing the tape out of the apparatus.

8. The strapping apparatus defined in claim 7 wherein the control means automatically stops the second drive roll a predetermined time after operation of the switch.

9. The strapping apparatus defined in claim 5 wherein the second drive means includes a reversible electric motor connected to the second drive roll.

10. The strapping apparatus defined in claim 5 wherein the first clamp means includes a switch connected to the control means and operable by insertion of the free tape end into the first clamp means, the control means operating the second drive means to draw the tape back into the apparatus after the switch is operated.

11. The strapping apparatus defined in claim 10 wherein the control means operates the second drive means to draw the tape back into the apparatus a predetermined time after the switch is operated.

12. The strapping apparatus defined in claim 10 wherein the switch is a time-delay switch.

13. The strapping apparatus defined in claim 5 wherein the second drive means includes a second motor and the control means monitors loading of the second motor and starts the first drive means when loading of the second drive motor exceeds a predetermined limit.

14. The strapping apparatus defined in claim 13 wherein the first drive means includes a first motor and the control means monitors loading of the first motor and operates the second clamp means to clamp the tape when loading of the first drive motor exceeds a predetermined limit.

15. The strapping apparatus defined in claim 14 wherein after operating the second clamp means to clamp the tape the control means operates the cutting means to sever the tape upstream of the second clamp means.

16. The strapping apparatus defined in claim 15 wherein after operating the second clamp means to clamp the tape the control means operates the joining means to secure the tape to itself upstream of the second clamp means and downstream of the cutting means.

17. The strapping apparatus defined in claim 5 wherein the second drive roll is provided with externally operable hand formations for manual rotation of the second drive roll.

18. The strapping apparatus defined in claim 1 wherein the drive means includes a motor and a worm-gear transmission connected between the motor and the drive shaft and constructed to be self-blocking.

19. The strapping apparatus defined in claim 1, further comprising:

spring means braced between the friction layer and the first drive roll for pressing the friction layer against the housing.

20. The strapping apparatus defined in claim 19 wherein the spring means is a plurality of Belleville washers.

* * * * *